US008753098B2

(12) United States Patent
Yokoyama et al.

(10) Patent No.: US 8,753,098 B2
(45) Date of Patent: Jun. 17, 2014

(54) REFRIGERANT COMPRESSOR

(75) Inventors: Tetsuhide Yokoyama, Tokyo (JP); Toshihide Koda, Tokyo (JP); Teruhiko Nishiki, Tokyo (JP); Hideaki Maeyama, Tokyo (JP); Taro Kato, Tokyo (JP); Keisuke Shingu, Tokyo (JP); Takuho Hirahara, Tokyo (JP); Shin Sekiya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 252 days.

(21) Appl. No.: 13/381,031

(22) PCT Filed: Jun. 26, 2009

(86) PCT No.: PCT/JP2009/061750

§ 371 (c)(1), (2), (4) Date: Dec. 27, 2011

(87) PCT Pub. No.: WO2010/150404

PCT Pub. Date: Dec. 29, 2010

(65) Prior Publication Data

US 2012/0107151 A1 May 3, 2012

(51) Int. Cl.

| | |
|---|---|
| ***F01C 21/04*** | (2006.01) |
| ***F01C 21/06*** | (2006.01) |
| ***F03C 2/00*** | (2006.01) |
| ***F03C 4/00*** | (2006.01) |

(52) U.S. Cl.

USPC ..... 418/83; 418/55.1; 418/63; 418/94; 418/151; 471/313; 471/372; 184/6.18

(58) Field of Classification Search

USPC ..... 418/55.1–55.6, 57, 63, 83, 94, 98, 100, 418/151, 270, DIG. 1; 417/366, 369, 372, 417/313; 184/6.16–6.18

See application file for complete search history.

(56) References Cited

U.S. PATENT DOCUMENTS 3,663,127 A * 5/1972 Cheers ..... 417/372
4,592,703 A * 6/1986 Inaba et al. ..... 418/94

(Continued)

FOREIGN PATENT DOCUMENTS

CN 1417474 A 5/2003
JP 48 75205 9/1973

(Continued)

OTHER PUBLICATIONS

Ogata, H., et al., "Reduction of Oil Discharge for Rolling Piston Compressor Using $CO_2$ Refrigerant," International Compressor 18th Engineering Conference at Purdue, CO95, pp. 1-7, (Jul. 17-20, 2006).

(Continued)

*Primary Examiner* — Theresa Trieu

(74) *Attorney, Agent, or Firm* — Oblon, Spivak, McClelland, Maier & Neustadt, L.L.P.

(57) ABSTRACT

A refrigerant compressor includes: an electric motor including a stator and rotor inside a sealed vessel; a compressing mechanism driven by a crank shaft in the rotor; a lower portion oil pool storing in the sealed vessel lubricating oil that lubricates the compressing mechanism; an upper counterweight on an upper end of the rotor. Refrigerant gas compressed by the compressing mechanism is discharged inside the sealed vessel, passes through a gas channel formed on the electric motor, moves from a lower space to an upper space with respect to the electric motor, and is discharged outside the sealed vessel. An oil return flow channel is formed on the upper end of the rotor toward a lower end from a vicinity of a leading end portion of the upper counterweight in a direction of rotation, and oil expressed in a vicinity of the rotor is directed to the oil return flow channel.

8 Claims, 7 Drawing Sheets

(56) References Cited

U.S. PATENT DOCUMENTS

| | | | | |
|---|---|---|---|---|
| 4,762,471 | A * | 8/1988 | Asanuma et al. | 184/6.18 |
| 2006/0192171 | A1 * | 8/2006 | Okaichi et al. | 417/313 |

FOREIGN PATENT DOCUMENTS

| | | |
|---|---|---|
| JP | 58 181992 | 12/1983 |
| JP | 61 21895 | 2/1986 |
| JP | 61 178091 | 11/1986 |
| JP | 62 253990 | 11/1987 |
| JP | 64 22879 | 2/1989 |
| JP | 2000 213483 | 8/2000 |
| JP | 2002 327693 | 11/2002 |
| JP | 2005 351122 | 12/2005 |
| JP | 2006 42544 | 2/2006 |
| JP | 3925392 | 3/2007 |
| JP | 2007 247647 | 9/2007 |

OTHER PUBLICATIONS

International Search Report Issued Sep. 15, 2009 in PCT/JP09/61750 Filed Jun. 26, 2009.

U.S. Appl. No. 13/377,678, filed Dec. 12, 2011, Yokoyama, et al.

U.S. Appl. No. 13/377,665, filed Dec. 12, 2011, Yokoyama, et al.

Office Action issued Feb. 11, 2014 in Chinese Patent Application No. 2009801600753 (pp. 1-9) with an English translation of the text portion of the Notification of the First Office Action (6 pages).

* cited by examiner

FIG.3

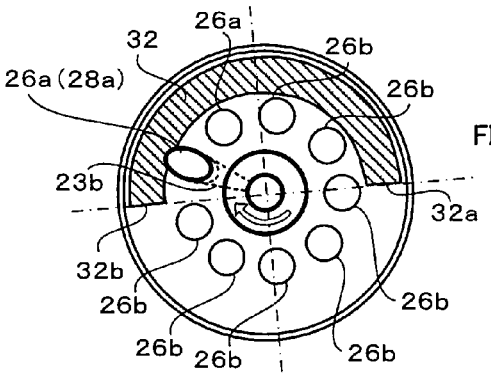

FIG.1

FIG.4

| | ITEM | TYPE |
|---|---|---|
| CALCULATING MEANS | Computational speed | 22.4GFLOPS |
| | Software | STAR-CD(v3.2) |
| COMPUTATIONAL MODEL | Rotating body calculating method | Moving boundary, non-stationary analysis |
| | Turbulent diffusion | Present (k-ε model) |
| | Calculating step | 3-degree intervals (7,200 Hz) |
| | Number of cells in overall computational model | 61,052 |
| | Number of cells in lower portion space computational model | 24,912 |
| OPERATING CONDITIONS | Motor rotational frequency | 60 Hz |
| | Operating pressure (at refrigerant inlet boundary) | 10 Mpa |
| | Operating temperature (refrigerant) | 90 degrees Celsius (363.15 K) constant |
| REFRIGERANT CONDITIONS | Refrigerant type | Carbon dioxide ($CO_2$ ) gas |
| | Gas entrance boundary positions | 2 discharging muffler outlets |
| | Rate of refrigerant inflow | 90 kg/h |
| | Gas inflow speed | 3.69 m/s |
| | Density | 206 kg/m$^2$ |

REFRIGERANT COMPRESSOR

TECHNICAL FIELD

The present invention relates to improvements to a construction that is highly effective in oil separation for electric motor-driven refrigerant compressors that are used in heat pump equipment and refrigerating cycle equipment.

BACKGROUND ART

Conventionally, in electric motor-driven refrigerant compressors that are used in heat pump equipment and refrigerating cycle equipment, torque from an electric motor is transmitted to a compressing mechanism by a crank shaft to compress a refrigerant gas using the compressing mechanism. The refrigerant gas is compressed by the compressing mechanism discharges into a sealed vessel, and moves from a lower space to an upper space relative to the electric motor through electric motor portion gas channels, and subsequently discharges to a refrigerant circuit outside the sealed vessel, but lubricating oil that is supplied to the compressing mechanism mixes with the refrigerant gas, and is discharged outside the sealed vessel. Conventionally, some problems have been that if the discharge rate of the oil that is removed to the refrigerant circuit increases, heat exchanger performance is reduced, and in addition if the amount of oil stored inside the sealed vessel is reduced, deterioration in reliability may arise due to lubrication failure.

In recent years, size-reducing developments in compressors, and conversion to alternative refrigerants (including natural refrigerants) that have a smaller environmental load have accelerated, and there is demand for oil separating techniques in the sealed vessel to be advanced. At the same time, since oil separating mechanisms inside the sealed vessel are complicated, and observational experiments also cannot be performed easily, there are many unexplained portions, and there are also many unsolved technical problems.

For example, refrigerant compressors have been disclosed in which are disposed as electric motor portion gas channels: a first gas channel that is constituted by a plurality of penetrating apertures (abbreviated to "rotor vents") that communicate axially between upper and lower ends of a rotor; a second gas channel that is constituted by an air gap that is secured between a rotor outer circumferential surface and a stator inner circumferential surface and groove portions that are formed in a stator from openings of winding accommodating slots to an inner circumferential surface of the stator; and a third gas channel that is formed on an outer circumferential side of the windings of the stator inside the sealed vessel inner wall and that is constituted by a plurality of penetrating apertures that communicate axially between upper and lower ends of a motor, flow channel cross-sectional area of the rotor vents that constitute the first gas channel being greatest, wherein a disciform oil separating plate is fitted over a crank shaft so as to be tightly fitted, and the oil separating plate is held so as to be separated from rotor vent upper ends by a predetermined clearance (see Patent Literature 1, for example).

Rotary compressors have also been disclosed in which a counterweight is used to make oil that is discharged from a gas vent aperture collide with a colliding portion so as to form a large mass and flow back (see Patent Literature 2, for example).

High-pressure shell scroll compressors have also been disclosed in which refrigerant that is sucked in is compressed by a compressing mechanism that is disposed in an upper portion inside a sealed vessel, then allowed to descend to an oil pool on a floor of the sealed vessel, then raised through an electric motor gas channel from an electric motor lower space to an upper space, and high-pressure gas is discharged from a compressor discharge pipe, by rotation of a fan that is mounted to an upper portion of an electric motor rotor, to control refrigerant gas flow and also facilitate oil separation (see Patent Literature 3, for example).

CITATION LIST

Patent Literature

Patent Literature 1: Japanese Patent Laid-Open No. 2007-2542140 (Gazette)

Patent Literature 2: Japanese Patent Laid-Open No. 2000-213483 (Gazette)

Patent Literature 3: Japanese Patent No. 3925392 (Gazette)

SUMMARY OF THE INVENTION

Problem to be Solved by the Invention

However, in the refrigerant compressor that is disclosed in Patent Literature 1, the oil that is separated by the oil separating rotating disk in the electric motor upper space is prone to accumulate on the upper side of the rotor and the stator and is prone to be discharged outside the sealed vessel, and as a result, one problem has been that the amount of stored oil that is available for lubrication is prone to be reduced.

In the rotary compressor that is disclosed in Patent Literature 2, because the oil that is discharged from the gas vent apertures is normally small (particle diameters of greater than or equal to 10 μm and less than or equal to 50 μm), even if discharged to the outer circumference at 3 m/s, the oil will not advance even 10 mm and is governed by the refrigerant gas flow, and in the end a large portion of the oil is picked up by the refrigerant gas flow that flows into the rotor vents, making it difficult to achieve the desired effects.

In the scroll compressor that is disclosed in Patent Literature 3, since the oil is prone to accumulate on the upper side of the rotor and the stator, there are similar problems to the refrigerant compressor that is disclosed in Patent Literature 1.

An object of the present invention is to provide a refrigerant compressor in which amount of discharge that is removed to a refrigerant circuit of lubricating oil that is supplied to a compressing mechanism is reduced.

Means for Solving the Problem

In order to achieve the above object, according to one aspect of the present invention, there is provided a refrigerant compressor including: an electric motor that is constituted by a stator and a rotor that are disposed inside a sealed vessel; a compressing mechanism that is driven by a crank shaft that is fitted into the rotor; a lower portion oil pool that stores in the sealed vessel a lubricating oil that lubricates the compressing mechanism; and an upper counterweight that is disposed on an upper end of the rotor, refrigerant gas that is compressed by the compressing mechanism being discharged inside the sealed vessel, and the discharged refrigerant gas passing through a gas channel that is formed on the electric motor, being moved from a lower space to an upper space with respect to the electric motor, and then being discharged outside the sealed vessel. An oil return flow channel is formed on the upper end of the rotor toward a lower end in a region in which there is positive pressure compared to operating pressure and in a vicinity of a leading end portion of the upper counterweight in a direction of rotation, and oil that is expressed in a vicinity of the rotor is directed to the oil return flow channel.

According to another aspect of the present invention, there is provided a refrigerant compressor including: an electric motor that is constituted by a stator and a rotor that are disposed inside a sealed vessel; a compressing mechanism that is driven by a crank shaft that is fitted into the rotor; a lower portion oil pool that stores in the sealed vessel a lubricating oil that lubricates the compressing mechanism; and a lower counterweight that is disposed on a lower end of the rotor, refrigerant gas that is compressed by the compressing mechanism being discharged inside the sealed vessel, and the discharged refrigerant gas passing through a gas channel that is formed on the electric motor, being moved from a lower space to an upper space with respect to the electric motor. and then being discharged outside the sealed vessel. An oil return flow channel is formed on the lower end of the rotor toward an upper end in a region in which there is negative pressure compared to operating pressure and in a vicinity of a trailing end portion of the lower counterweight in a direction of rotation, and oil that is expressed in a vicinity of the rotor is directed to the oil return flow channel.

Effects of the Invention

The effects of the refrigerant compressor according to the present invention are that discharge rate of oil that is removed from the compressor to the refrigerant circuit can be reduced, thereby enabling deterioration in heat exchanger performance to be suppressed, and that deterioration in reliability due to lubrication failure due to the amount of stored oil inside the sealed vessel being reduced can be suppressed.

BRIEF DESCRIPTION OF THE DRAWINGS

FIG. 3 is a schematic layout of lateral cross section B in FIG. 1;

FIG. 4 is a table that shows items of numerical calculation and conditions for finding a downward gas channel;

DESCRIPTION OF EMBODIMENTS

Embodiment 1

Figure 1:
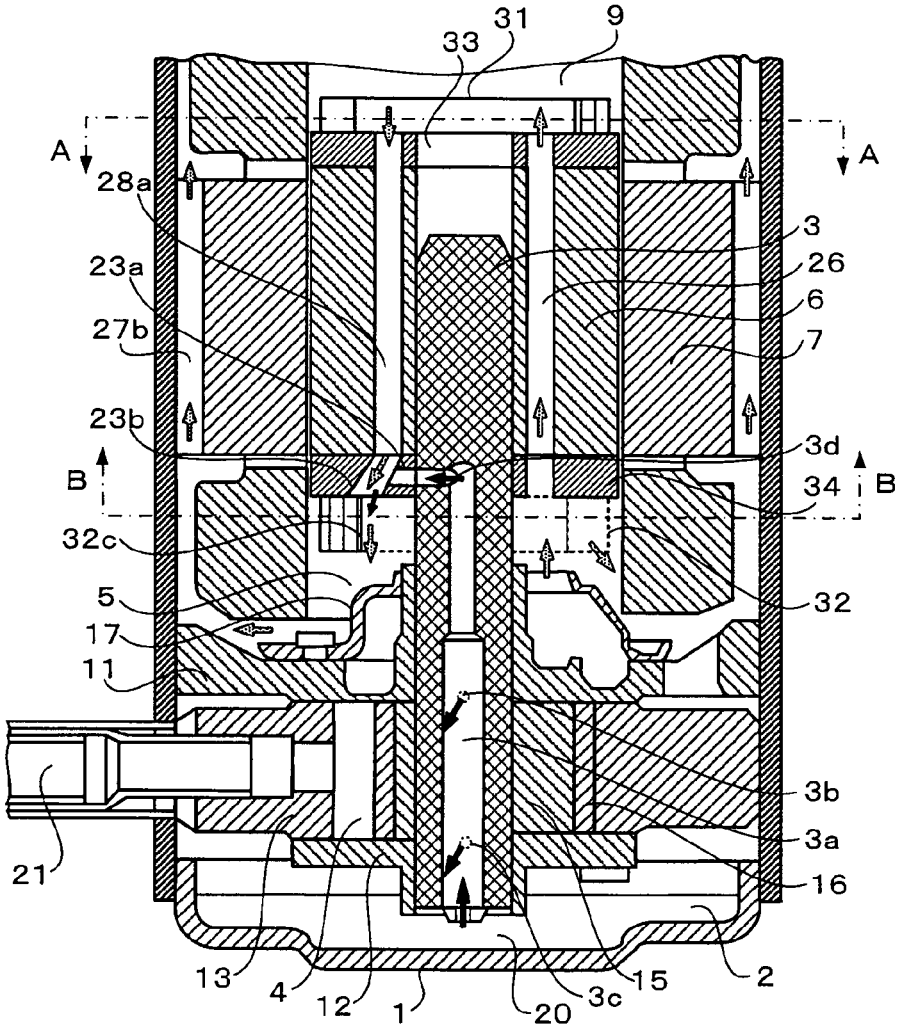
FIG. 1 is a longitudinal cross section that shows a construction of a rotary compressor according to Embodiment 1 of the present invention.
Figure 2:
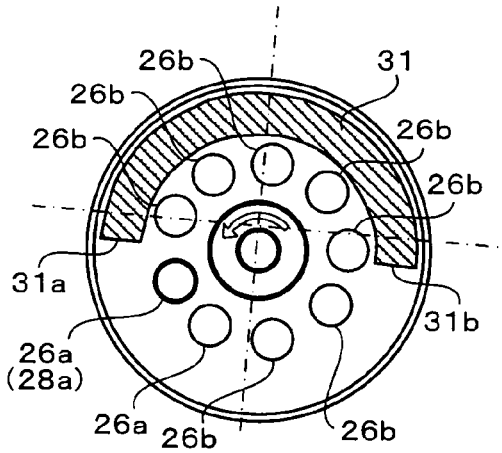
FIG. 2 is a schematic layout of lateral cross section A in FIG. 1.

FIG. 1 is a longitudinal cross section that shows a construction of a rotary compressor according to Embodiment 1 of the present invention. FIG. 2 is a schematic layout of lateral cross section A in FIG. 1. FIG. 3 is a schematic layout of lateral cross section B in FIG. 1.

First, basic construction and operation of a rotary compressor that functions as a refrigerant compressor according to Embodiment 1 of the present invention will be explained. Moreover, in FIG. 1, solid black arrows indicate oil flow, and stippled arrows indicate refrigerant gas flow.

As shown in FIG. 1, a rotary compressor according to Embodiment 1 of the present invention includes: an electric motor that has a stator 7 and a rotor 6; and a compressing mechanism to which torque from the electric motor is transmitted by the crank shaft 3, and in which refrigerant gas is compressed inside a cylinder chamber 4.

The compressing mechanism includes: an upper bearing member 11; a lower bearing member 12; a cylinder 13 that is positioned between the upper bearing member 11 and the lower bearing member 12; a cylinder chamber 4 that is formed by the upper bearing member 11, the lower bearing member 12, and the cylinder 13; a cylindrical eccentric pin portion 15 that is disposed eccentrically on the crank shaft 3, and that rotates together with the rotation of the crank shaft 3; and a cylindrical rotating piston 16 that revolves inside the cylinder chamber 4 while contacting an outer circumference of the eccentric pin portion 15 due to rotation of the eccentric pin portion 15.

In the compressing mechanism, refrigerant gas that is sucked in through the refrigerant gas suction pipe 21 is compressed inside the cylinder chamber 4 by the revolution of the rotating piston 16. By opening a discharging port by pushing a valve (not shown) that is disposed on an upper surface of the upper bearing member 11 upward when it reaches a predetermined pressure, the compressed refrigerant gas passes from a space that is surrounded by the discharging muffler 17 through an electric motor lower space 5 and a stator outer circumferential portion notch 27*b*, passes sequentially through an electric motor upper space 9 and a discharging pipe (not shown), and is conveyed to a condenser.

A hollow aperture 3*a* that sucks up oil (lubricating oil) 20 axially from a lower portion oil pool 2 by rotary pump action is opened in the crank shaft 3. Lubricating apertures 3*b* and 3*c* are also opened in the crank shaft 3 in radial directions extending from the hollow aperture 3*a* at respective lubricating positions. A gas vent aperture 3*d* that blows out onto an outer circumference in a vicinity of a top portion of the hollow aperture 3*a* is also opened in the crank shaft 3.

The rotor 6, which is made of laminated steel plates, is held between a rotor upper portion fixed plate 33 from an upper end, and a rotor lower portion fixed plate 34 from a lower end. As shown in FIG. 2, a semi-annular upper counterweight 31 is disposed above the rotor upper portion fixed plate 33 in a semicircle around an outer circumferential edge of the rotor upper portion fixed plate 33. As shown in FIG. 3, a semi-annular lower counterweight 32 is disposed below the rotor lower portion fixed plate 34 in a semicircle around an outer circumferential edge of the rotor lower portion fixed plate 34 so as to be in opposite phase to the layout of the upper counterweight 31. Specifically, "opposite phase" means that the lower counterweight 32 is disposed so as to overlap with a position at which the position of the upper counterweight 31 is rotated by 180 degrees around a central axis of the rotor 6 and projected in the direction of the central axis. Thus, the upper counterweight 31 and the lower counterweight 32 rotate together with the crank shaft 3 and adopt a dynamic mass balance.

A gas channel that is constituted by nine apertures that pass axially through the upper and lower ends, i.e., nine rotor vents 26, are disposed on the rotor 6, the rotor upper portion fixed plate 33, and the rotor lower portion fixed plate 34. Moreover, rotor vents 26 that are disposed from the front in the direction of rotation of the upper counterweight 31 to a position on the rotor upper portion fixed plate 33 at which the phase is advanced forward by 90 degrees in the direction of rotation will be designated downward gas channels 26*a*, and all other rotor vents 26 will be displayed distinctively as upward gas channels 26*b*. One of the downward gas channels 26*a* is used as an oil return flow channel 28*a*.

Moreover, the rotor vents 26 that are disposed on the rotor upper portion fixed plate 33 and the rotor lower portion fixed plate 34 have openings that are nearer to center than the upper counterweight 31 and the lower counterweight 32 in the radial direction of the upper counterweight 31 and the lower counterweight 32.

A flow channel 23*a* that directs high-density oil that is discharged from the gas vent aperture 3*d* that is opened in the crank shaft 3 towards an outer circumference, and a flow channel 23*b* that extends to one of the downward gas channels 26*a* that are opened on the rotor 6 and extends to the flow channel 23*a*, are disposed on the rotor lower portion fixed plate 34.

An upper end of the flow channel 23*b* extends to a lower outlet of the downward gas channel 26*a*, and a lower end has an opening in a vicinity of a guiding groove 32*c* on a side wall of the lower counterweight 32.

An oil return flow channel is formed by the flow channel 23*b*, the flow channel 23*a*, and the downward gas channel 26*a* that extends to the flow channel 23*b*.

Oil that is sucked up from the lower portion oil pool 2 through the lower end of the hollow aperture 3*a* by rotary pump action is supplied through the lubricating apertures 3*b* and 3*c* that are open at the respective lubricating positions to perform lubrication.

Oil that is blown out through the gas vent aperture 3*d* that is open in the vicinity of the top portion of the hollow aperture 3*a* toward the outer circumference passes through the flow channel 23*a* and merges with the refrigerant gas that has descended through the downward gas channels 26*a* at the flow channel 23*b*. The merged oil and refrigerant gas passes along the guiding grooves 32*c* on the side wall of the lower counterweight 32, and is sprayed in the direction of the lower portion oil pool 2 in the sealed vessel, allowing the oil to flow back.

Moreover, the refrigerant gas and the oil can be separated more easily if discharged so as to collide into the side wall of the lower counterweight 32.

In a rotary compressor according to Embodiment 1 of the present invention, as has been described above, among the rotor vents 26 that are opened in the rotor 6, the downward gas channels 26*a* that the refrigerant gas descends communicate at the flow channels 23*a* and 23*b* with the gas vent apertures 3*d* that suck up the oil from the lower portion oil pool 2 and blow it out toward the outer circumference, and the refrigerant gas and the oil merge, but the technique for determining the downward gas channels 26*a* will now be explained.

Figure 5:
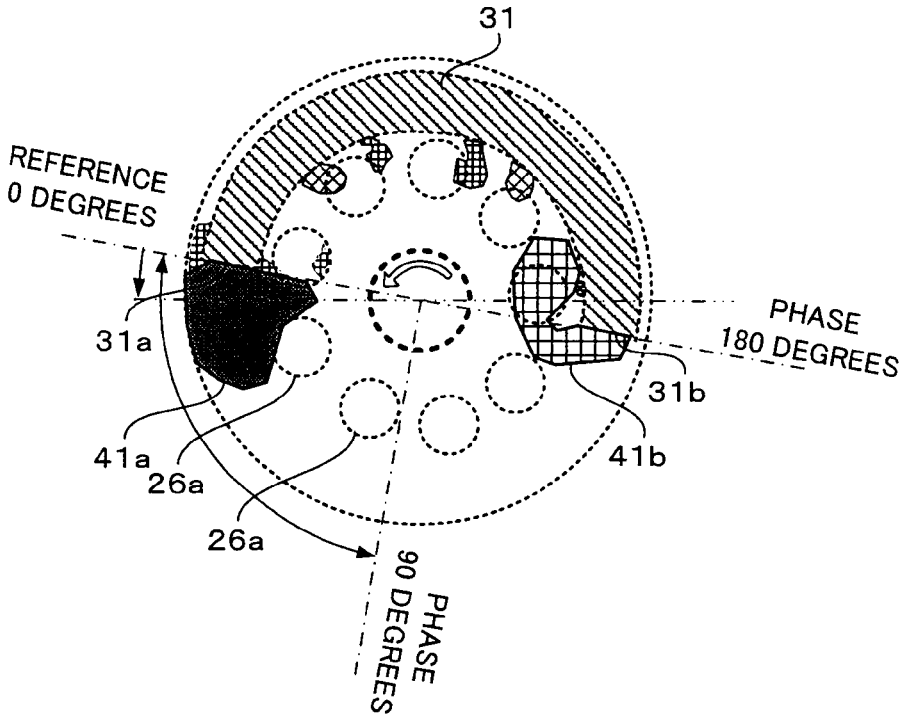
FIG. 5 is a diagram that shows static pressure distribution in lateral cross section A of the rotary compressor according to Embodiment 1 of the present invention.
Figure 6:
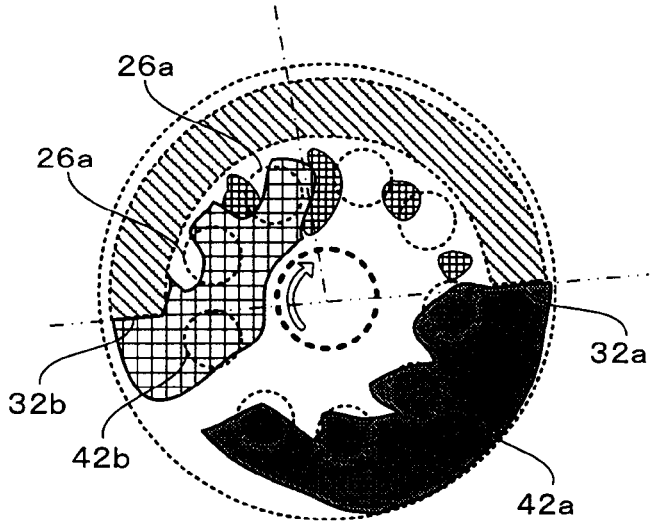
FIG. 6 is a diagram that shows static pressure distribution in lateral cross section B of the rotary compressor according to Embodiment 1 of the present invention.

FIG. 4 is a table that shows items of numerical calculation and conditions for finding the downward gas channel 26*a*. FIG. 5 is a diagram that shows static pressure distribution in lateral cross section A of the rotary compressor according to Embodiment 1 of the present invention. FIG. 6 is a diagram that shows static pressure distribution in lateral cross section B of the rotary compressor according to Embodiment 1 of the present invention.

The numerical calculations were calculated by a three-dimensional common thermohydrodynamic analysis tool (STAR-CD (v3.2)) using an electronic computer with a computational speed of 22.4 GFLOPS. In calculating, rotating portions of the electric motor (the rotor 6, the rotor upper portion fixed plate 33, the rotor lower portion fixed plate 34, the upper counterweight 31, and the lower counterweight 32) were assumed to be a moving boundary, and calculation was performed using non-stationary analytical techniques.

The type of refrigerant was carbon dioxide, operating pressure was 10 MPa, and the rate of refrigerant inflow was 90 kg/h.

As shown in FIG. 5, with respect to the upper portion rotating portions (the rotor upper portion fixed plate 33 and the upper counterweight 31), a region 41*a* in which there is positive pressure compared to the operating pressure, namely, greater than or equal to 600 Pa, arises in a vicinity of a leading end portion 31*a* of the upper counterweight 31 in the direction of rotation. The maximum value of the pressure in the region 41*a* is 4,160 Pa.

A region 41*b* in which there is negative pressure compared to the operating pressure, namely, the absolute value of the negative pressure is greater than or equal to 600 Pa, arises in a vicinity of a trailing end portion 31*b* of the upper counterweight 31 in the direction of rotation and in a space inside the upper counterweight 31. The maximum absolute value of negative pressure in the region 41*b* is 4,160 Pa.

As shown in FIG. 6, with respect to the lower portion rotating portions (the rotor lower portion fixed plate 34 and the lower counterweight 32), a region 42*a* in which there is positive pressure compared to the operating pressure, namely, greater than or equal to 740 Pa, arises in a vicinity of a leading end portion 32*a* of the lower counterweight 32 in the direction of rotation. The maximum value of the pressure in the region 42*a* is 5,120 Pa.

A region 42*b* in which there is negative pressure compared to the operating pressure, namely, the absolute value of the negative pressure is greater than or equal to 690 Pa, arises in a vicinity of a trailing end portion 32*b* of the lower counterweight 32 in the direction of rotation and in a space inside the lower counterweight 32. The maximum absolute value of the negative pressure in the region 42*b* is 4,960 Pa.

Among the nine rotor vents 26, a region 41*a* in which there is positive pressure compared to the operating pressure arises in a vicinity of the rotor vents 26 that are opened in the rotor upper portion fixed plate 33 from the leading end portion 31*a* of the upper counterweight 31 in the direction of rotation to a position that is 90 degrees forward in the direction of rotation. At the same time, because a region 42*b* in which there is negative pressure compared to the operating pressure arises in a vicinity of where the second ends of the rotor vents 26 of the rotor lower portion fixed plate 34 have openings, a large pressure difference arises between the two ends of the rotor vents 26, giving rise to a downward flow from an upper side of the rotor 6 to a lower side.

Because the flow channel 23*b* that extends from the top portion of the hollow aperture 3*a* extends to the rotor vents 26*a* in which the downward flow arises, oil from the hollow aperture 3*a* is returned to the lower portion oil pool 2 by the downward flow.

In a rotary compressor according to Embodiment 1 of the present invention, the oil that is ejected from the gas vent apertures 3*d* is not picked up by the upward flowing refrigerant gas flow that flows into the upward gas channels 26*b*, facilitating flow back to the lower portion oil pool 2 inside the sealed vessel, and enabling the discharge rate of the oil that is removed from the compressor to the refrigerant circuit to be reduced, thereby enabling deterioration in heat exchanger performance to be suppressed, and also enabling suppression of deterioration in reliability due to defective lubrication due to the amount of stored oil inside the sealed vessel being reduced.

Embodiment 2

Figure 7:
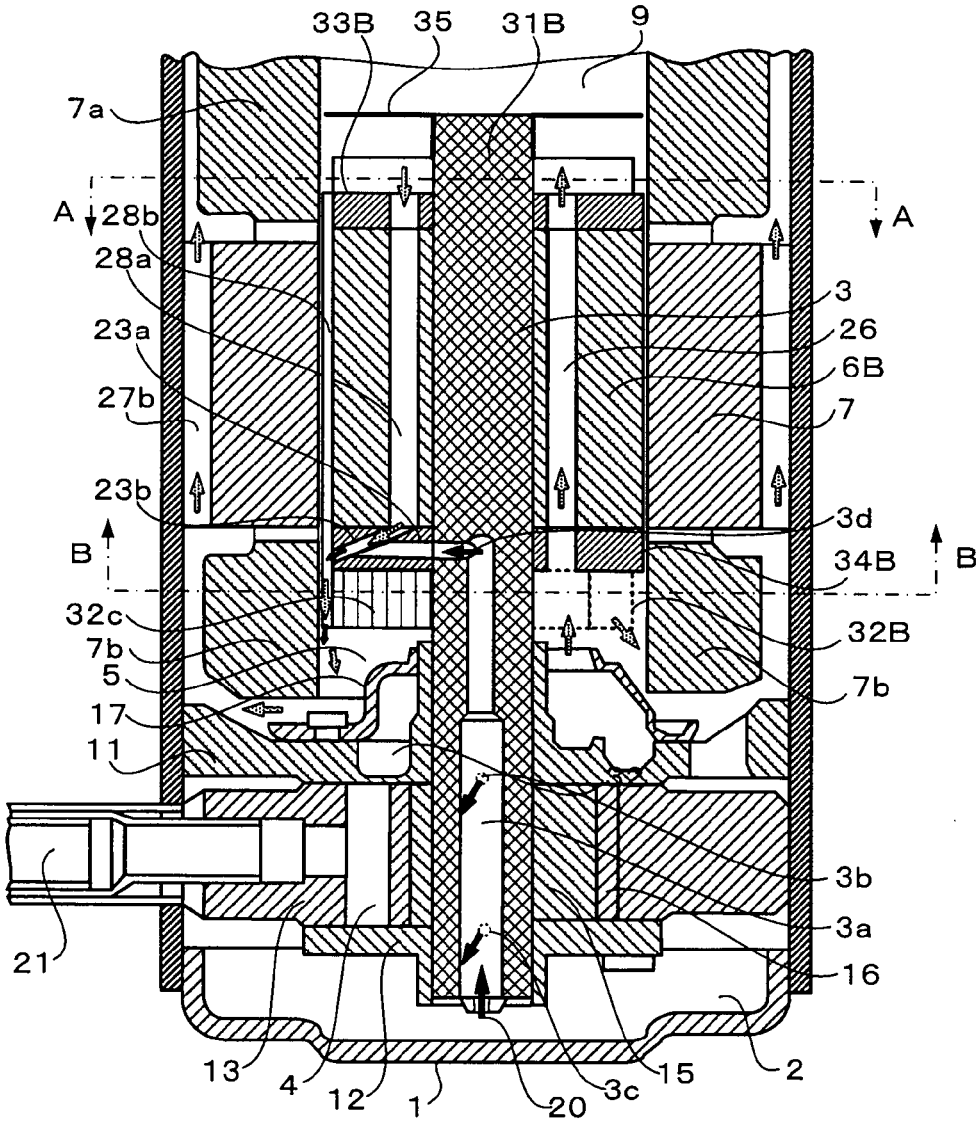
FIG. 7 is a longitudinal cross section that shows a construction of a rotary compressor according to Embodiment 2 of the present invention.
Figure 8:
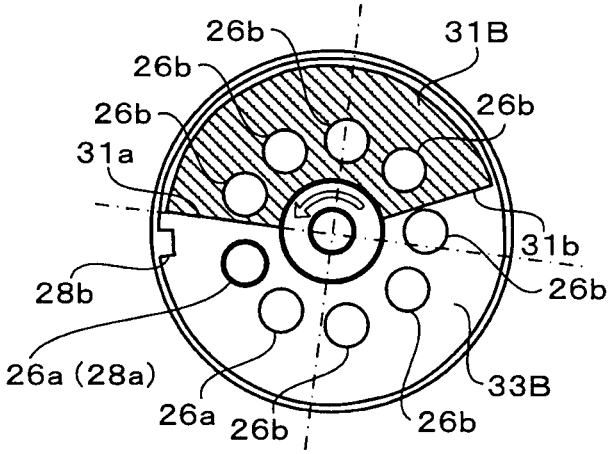
FIG. 8 is a schematic layout of lateral cross section A in FIG. 7.
Figure 9:
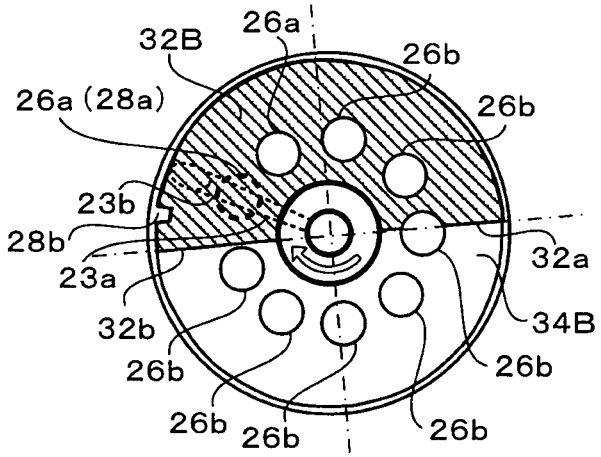
FIG. 9 is a schematic layout of lateral cross section B in FIG. 7.

FIG. 7 is a longitudinal cross section that shows a construction of a rotary compressor according to Embodiment 2 of the present invention. FIG. 8 is a schematic layout of lateral cross section A in FIG. 7. FIG. 9 is a schematic layout of lateral cross section B in FIG. 7.

In a rotary compressor according to Embodiment 2 of the present invention, an oil separating plate 35 is added to the rotary compressor according to Embodiment 1 of the present invention, and a rotor 6B, an upper counterweight 31B, a lower counterweight 32B, a rotor upper portion fixed plate 33B, and a rotor lower portion fixed plate 34B are different, and because other portions are similar, identical numbering will be given to similar portions and explanation thereof will be omitted.

A ring-shaped oil separating plate 35 is fitted over an upper end portion of the crank shaft 3 so as to be tightly fitted, and is held so as to be separated from the upper ends of the rotor vents 26 of the upper counterweight 31B by a predetermined clearance.

The upper counterweight 31B according to Embodiment 2 of the present invention has a semi-annular shape that has a different width than the upper counterweight 31 according to Embodiment 1 of the present invention, and has a surface area that covers approximately half of the upper end surface of the rotor 6B. When the upper counterweight 31B is fixed to the rotor upper portion fixed plate 33B, penetrating apertures are open at positions that are superposed over the rotor vents 26. Thus, there is no inner region in the upper counterweight 31B.

In the rotor upper portion fixed plate 33B according to Embodiment 2 of the present invention, a notch is disposed on a circumferential side surface of the rotor upper portion fixed plate 33 according to Embodiment 1 of the present invention in an axial direction of the crank shaft 3 at a position that is superposed over the oil return flow channel 28*b* when the rotor 6B is held from opposite sides.

The lower counterweight 32B according to Embodiment 2 of the present invention has a semi-annular shape that has a different width than the lower counterweight 32 according to Embodiment 1 of the present invention, and has a surface area that covers approximately half of the lower end surface of the rotor 6B. When the lower counterweight 32B is fixed to the rotor lower portion fixed plate 34B, penetrating apertures are open at positions that are superposed over the rotor vents 26. Thus, there is no inner region in the lower counterweight 32B.

In the rotor lower portion fixed plate 34B according to Embodiment 2 of the present invention, a notch is disposed on a circumferential side surface of the rotor lower portion fixed plate 34 according to Embodiment 1 of the present invention in an axial direction of the crank shaft 3 at a position that is superposed over the oil return flow channel 28*b* when the rotor 6B is held from opposite sides. The first end of the flow channel 23Bb that extends to the oil return flow channel 28*b* has an opening on a side surface that faces an electric motor lower portion coil portion 7*b*.

In the rotor 6B according to Embodiment 2 of the present invention, a notch that functions as an oil return flow channel 28*b* that is parallel to the crank shaft 3 is disposed on a circumferential side surface of the rotor 6 according to Embodiment 1 of the present invention. The position at which the first end of the oil return flow channel 28*b* appears on the rotor upper portion fixed plate 33B is a position that slightly precedes the phase in the direction of rotation from the leading end portion 31*a* of the upper counterweight 31B in the direction of rotation.

So as not to leak the high-density oil that is discharged from the gas vent apertures 3*d*, the flow channel 23*a* that leads to the flow channel 23*b* is formed inside the rotor lower portion fixed plate 34B, and the flow channel 23*b* that leads to the electric motor lower portion coil portion 7*b* after merging into the oil return flow channel 28*a* is formed inside the lower counterweight 32B, and sprays obliquely downward toward the electric motor lower portion coil portion 7*b*.

Thus, the refrigerant gas and the oil are easily separated by making the oil adhere to the electric motor lower portion coil portion 7*b*.

The ring-shaped oil separating plate 35 is fitted over an upper end portion of the crank shaft 3 so as to be tightly fitted, and the oil separating plate 35 is held so as to be separated from the upper ends of the rotor vents 26 by a predetermined clearance.

The oil that is separated by the oil separating plate 35 of the electric motor upper space 9 is prone to accumulate above the rotor 6B and the stator 7. An oil pool 20*b* is particularly prone to form between an outer circumferential upper portion of the rotor 6B and the stator 7. Normally, oil accumulates in narrow gaps such as air gaps, and when upthrust force due to flow channel vertical differential pressure is greater than gravitational force, oil that has a high viscosity is prone to accumulate. Thus, the oil return flow channel 28*b* is formed so as to pass through top and bottom ends of the stator 7 in the vicinity of the leading end portion 31*a* of the upper counterweight 31B in the direction of rotation as a notched groove in which a portion of the outer circumferential surface of the rotor 6B is notched axially.

By using the positive pressure in the vicinity of the leading end portion 31*a* of the upper counterweight 31B in the direction of rotation, oil that accumulates in the oil pool 20*b* that forms on the upper portion of the stator 7 can be returned actively to the electric motor lower space 5 at the upstream end.

If the oil is directed to the electric motor lower portion coil portion 7*b* in this manner, the oil adheres to the electric motor lower portion coil portion 7*b*, enabling separation of the refrigerant gas and the oil to be expedited.

Using this kind of construction, oil that is separated in the electric motor upper space will not accumulate above the stator, and is able to flow back toward the electric motor lower space, and also toward the lower portion oil pool, reducing the discharge rate of oil outside the compressor, and since the enclosed lubricating oil is used effectively, effects that suppress deterioration in heat exchanger performance, and effects that suppress deterioration in reliability due to defective lubrication due to the amount of stored oil inside the sealed vessel being reduced can be achieved.

Embodiment 3

Figure 10:
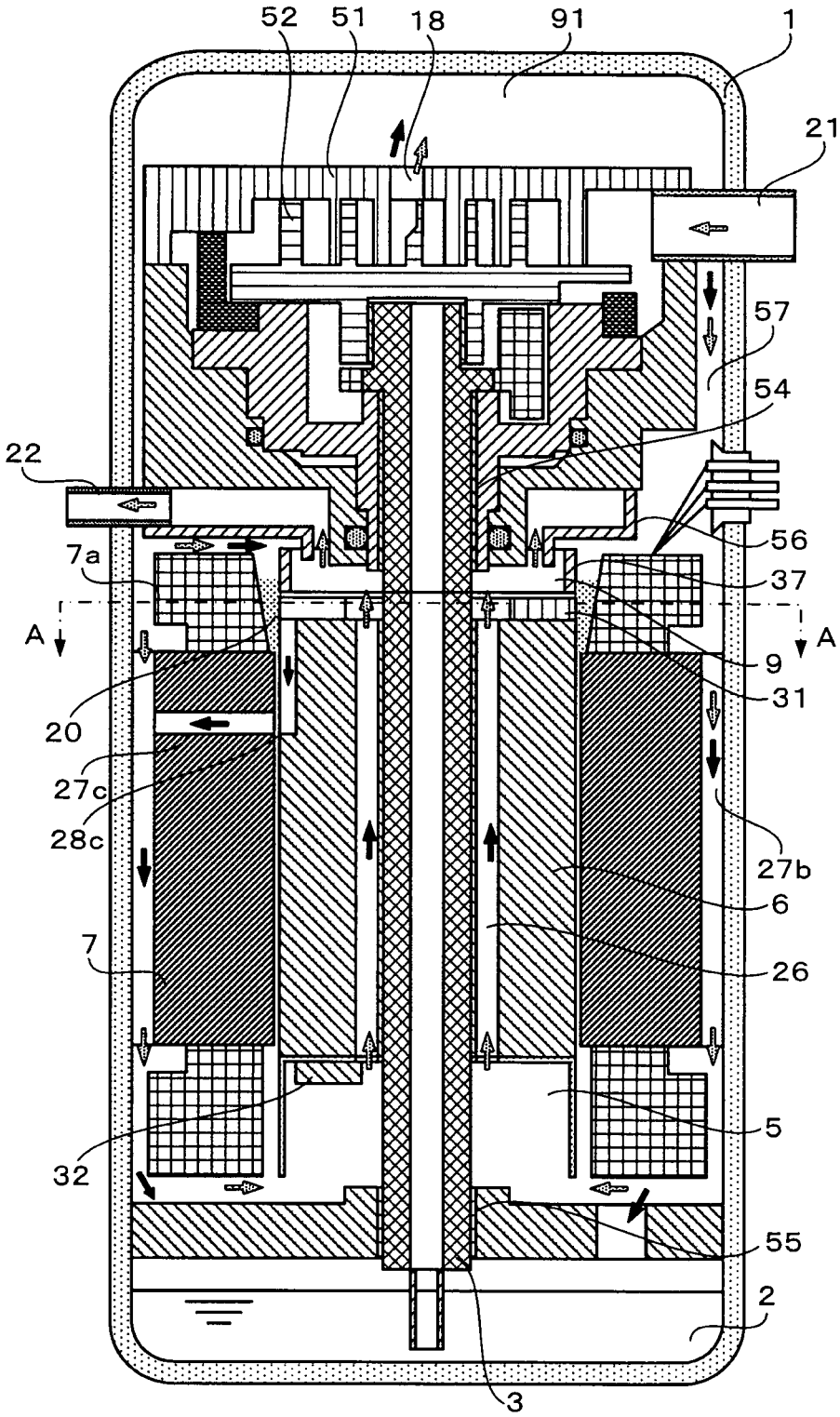
FIG. 10 is a longitudinal cross section that shows a construction of a scroll compressor according to Embodiment 3 of the present invention.
Figure 11:
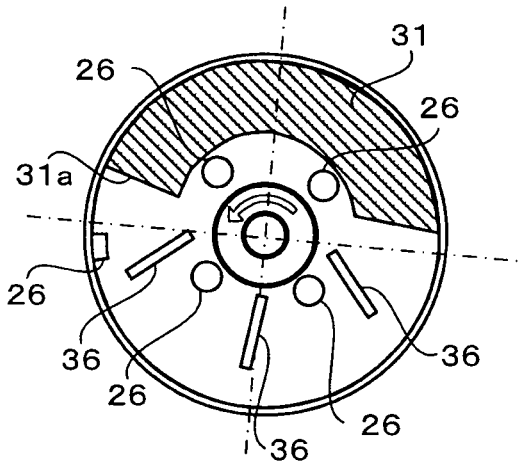
FIG. 11 is a schematic layout of lateral cross section A in FIG. 10.
Figure 12:
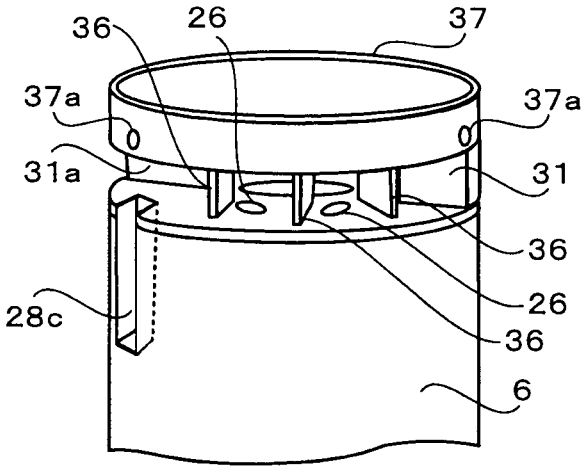
FIG. 12 is a perspective that shows a rotor upper portion of the scroll compressor according to Embodiment 3 of the present invention.

FIG. 10 is a longitudinal cross section that shows a construction of a scroll compressor according to Embodiment 3 of the present invention. FIG. 11 is a schematic layout of lateral cross section A in FIG. 10. FIG. 12 is a perspective that shows a rotor upper portion of the scroll compressor according to Embodiment 3 of the present invention.

A scroll compressor according to Embodiment 3 of the present invention includes a scroll compressing mechanism and an electric motor, and because the scroll compressor is conventional, configuration thereof will be explained simply.

The electric motor differs in that oil return flow channels have been added, and because other portions thereof are conventional, configuration thereof will be explained simply.

The scroll compressing mechanism includes: a fixed scroll 51; a crank shaft 3 that is supported rotatably by a main bearing 54 and an auxiliary bearing 55; and an orbiting scroll 52 that is fitted over and driven by a first end of the crank shaft 3, and that forms a compression chamber between itself and the fixed scroll 51.

The electric motor includes: a rotor 6 that is fitted over the crank shaft 3; and a stator 7. Rotor vents 26 that pass axially through the crank shaft 3 are disposed in the rotor 6, and an upper counterweight 31 and blades 36 that constitute an oil separating fan are fixed to an upper end of the rotor 6, and a lower counterweight 32 is fixed to a lower end. A rotor notch 28*c* that has a predetermined length in an axial direction of the crank shaft 3 is disposed on an outer circumferential surface of the rotor 6 from the upper end surface onto which the upper counterweight 31 is fixed.

An oil separating cup 37 that is separated by a predetermined distance from openings where the rotor vents 26 open onto the upper end surface of the rotor 6 is fitted over the crank shaft 3. Oil removing apertures 37*a* are opened in the oil separating cup 37.

The stator outer circumferential portion notch 27*b*, which extends in an axial direction of the crank shaft 3, is disposed on the outer circumferential surface of the stator 7. A stator radially penetrating aperture 27*c* that passes radially through the stator 7 is disposed in the stator 7 such that a first end faces a lower end of the rotor notch 28*c*, and so as to extend to the stator outer circumferential portion notch 27*b* at a second end.

Next, refrigerant and lubricating oil flows will be explained.

Low-pressure refrigerant that is sucked in through a refrigerant gas suction pipe 21 is led to a compression chamber, and the refrigerant is compressed to high pressure by reduction in volume of the compression chamber that accompanies the eccentric gyrating motion of the orbiting scroll 52. The refrigerant that is at high pressure is discharged to a discharging space 91 inside the sealed vessel 1 through discharging ports 18 on the fixed scroll 51. When the refrigerant that is at high pressure is discharged to the discharging space 91, the lubricating oil is discharged together therewith.

The refrigerant and the lubricating oil that are discharged to the discharging space 91 flow downward through a refrigerant flow channel 57 that is formed by the compressing mechanism and the sealed vessel 1, and through the stator circumference portion notch 27*b*, and then descend toward the lower portion space of the sealed vessel 1, and are turned around to reach the electric motor lower space 5. Then, the refrigerant and the lubricating oil that have reached the electric motor lower space 5 pass through the rotor vents 26 to reach the electric motor upper space 9. The lubricating oil that is separated in this step is returned to an oil pool 2 in a lower portion of the sealed vessel 1.

There is also a portion of the refrigerant and the lubricating oil that have flowed through the refrigerant flow channel 57 that passes through a gap between an electric motor upper portion coil portion 7*a* and the compressing mechanism to reach the electric motor upper space 9. Moreover, this gap is disposed in order to prevent the electric motor upper portion coil portion 7*a* contacting the compressing mechanism and short-circuiting.

The refrigerant and the lubricating oil that have reached the electric motor upper space 9 are separated by the oil separating cup 37, and the separated refrigerant passes through a compressor discharging guide 56 to reach a compressor discharging pipe 22. The separated lubricating oil, on the other hand, is blown out radially from the oil removing apertures 37*a* of the oil separating cup 37, and temporarily accumulates in an oil pool 20 in a gap between the electric motor upper portion coil portion 7*a* and the rotor 6. Since the vicinity of the leading end portion 31*a* of the upper counterweight 31 in the direction of rotation is at positive pressure, the lubricating oil that has accumulated in the oil pool 20 passes through the rotor outer circumferential portion notch 28*b* and is pushed out to the stator outer circumferential portion notch 27*b*, and the lubricating oil that is pushed out passes through the rotor outer circumferential portion notch 27*b* and is allowed to flow to the lower portion space of the sealed vessel 1 to be returned to the oil pool 2.

In a scroll compressor according to Embodiment 3 of the present invention, oil that is separated in the electric motor upper space 9 will not accumulate above the stator 7, and is able to flow back toward a space upstream from the electric motor, and also toward the oil pool 2, reducing the discharge rate of oil outside the compressor, and since the enclosed lubricating oil is used effectively, deterioration in heat exchanger performance can be suppressed, and deterioration in reliability due to defective lubrication due to the amount of stored oil inside the sealed vessel being reduced can also be suppressed.

In Embodiments 1 and 2 above, a high-pressure sealed-shell rotary piston rotary compression compressor, and in Embodiment 3 above, a high-pressure sealed-shell scroll compression compressor, have been explained, but similar effects can also be achieved by using a means that is similar to those of Embodiments 1 through 3, even using another shell type or another compression type, provided that the compressor is one in which the layout of the rotor 6 and the stator 7 of the electric motor is similar, and the refrigerant flows from the electric motor lower space 5 to the electric motor upper space 9. For example, similar effects can also be achieved by using a means that is similar to those of Embodiments 1 through 3 in a vented or intermediate-pressure shell compressor.

Furthermore, similar effects can also be achieved by using a means that is similar to those of Embodiments 1 through 3 in a compressor of another rotary compression type such as sliding vane, swing, etc.

In Embodiments 1 and 2, cases that include an upper counterweight and a lower counterweight that are mounted respectively to an upper end and a lower end of a rotor in opposite phase have been explained, but even if a counterweight is only on one of either the upper end or the lower end of the rotor (normally the counterweight is required to be on a side near the compressing mechanism), similar effects can also be achieved using similar means provided that characteristics by which there is positive pressure in the vicinity of a leading end portion of the counterweight in the direction of rotation, and negative pressure in the vicinity of the trailing end portion of the counterweight in the direction of rotation, and characteristics by which an inner region is prone to be at lower pressure than the counterweight inner circumference are used.

The invention claimed is:

1. A refrigerant compressor comprising:

an electric motor that is constituted by a stator and a rotor that are disposed inside a sealed vessel;

a compressing mechanism that is driven by a crank shaft that is fitted into said rotor;

a lower portion oil pool that stores in said sealed vessel a lubricating oil that lubricates said compressing mechanism; and an upper counterweight that is disposed on an upper end of said rotor, refrigerant gas that is compressed by said compressing mechanism being discharged inside said sealed vessel, and said discharged refrigerant gas passing through a gas channel that is formed on said electric motor, being moved from a lower space to an upper space with respect to said electric motor, and then being discharged outside said sealed vessel, wherein:

an oil return flow channel is formed on said upper end of said rotor toward a lower end in a region in which there is positive pressure compared to operating pressure and in a vicinity of a leading end portion of said upper counterweight in a direction of rotation; and oil that is expressed in a vicinity of said rotor is directed to said oil return flow channel.

2. A refrigerant compressor according to claim 1, comprising a plurality of rotor vents that pass axially through upper and lower ends of said rotor, at least one of said rotor vents also serving as said oil return flow channel, and merges with a flow channel that sucks up oil from the oil pool in a lower portion of said sealed vessel and directs oil that is discharged radially outward from gas vent apertures of said crank shaft.

3. A refrigerant compressor according to claim 1, wherein said oil return flow channel is formed into a flow channel that communicates between a upper space and a space downstream from said upper space relative to said electric motor by cutting away a portion of an outer circumferential side surface of said rotor downward from an upper end in a vicinity of the leading end portion of said upper counterweight in a direction of rotation.

4. A refrigerant compressor according to claim 1, wherein said oil return flow channel is formed in a region in a range that is half an angle in said direction of rotation from a phase reference that is the leading end portion of said upper counterweight in said direction of rotation to a trailing end portion of said upper counterweight in said direction of rotation.

5. A refrigerant compressor comprising:

an electric motor that is constituted by a stator and a rotor that are disposed inside a sealed vessel;

a compressing mechanism that is driven by a crank shaft that is fitted into said rotor;

a lower portion oil pool that stores in said sealed vessel a lubricating oil that lubricates said compressing mechanism; and a lower counterweight that is disposed on a lower end of said rotor, refrigerant gas that is compressed by said compressing mechanism being discharged inside said sealed vessel, and said discharged refrigerant gas passing through a gas channel that is formed on said electric motor, being moved from a lower space to an upper space with respect to said electric motor, and then being discharged outside said sealed vessel, wherein:

an oil return flow channel is formed on said lower end of said rotor toward an upper end in a region in which there is negative pressure compared to operating pressure and in a vicinity of a trailing end portion of said lower counterweight in a direction of rotation; and oil that is expressed in a vicinity of said rotor is directed to said oil return flow channel.

6. A refrigerant compressor according to claim 5, wherein oil that merges with said refrigerant gas in said oil return flow channel is directed to a stator side surface that is in a space below said rotor.

7. A refrigerant compressor according to claim 5, wherein said oil return flow channel has an opening at the lower end of said rotor inside an inner circumference of said lower counterweight, which has a semi-circular ring shape.

8. A refrigerant compressor according to claim 5, comprising a plurality of rotor vents that pass axially through upper and lower ends of said rotor, at least one of said rotor vents also serving as said oil return flow channel, and merges with a flow channel that sucks up oil from the oil pool in a lower portion of said sealed vessel and directs oil that is discharged radially outward from gas vent apertures of said crank shaft.

* * * * *